US012416236B2

(12) United States Patent
Jones et al.

(10) Patent No.: US 12,416,236 B2
(45) Date of Patent: Sep. 16, 2025

(54) PROTECTION OF A WELLBORE TOOL USING FLUID MEDIUM DEPENDENT MATERIAL

(71) Applicant: Halliburton Energy Services, Inc., Houston, TX (US)

(72) Inventors: Christopher Michael Jones, Houston, TX (US); Jay Deville, Houston, TX (US); Anthony Herman VanZuilekom, Houston, TX (US); Matthew L. Lee, Houston, TX (US); Darren George Gascooke, Houston, TX (US); Pramod Chamarthy, Carrollton, TX (US); Bin Dai, Houston, TX (US); Roger L. Shelton, Houston, TX (US); Marcus Ray Hudson, Houston, TX (US); Zhonghuan Chen, Singapore (SG); James Cernosek, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 18/102,350

(22) Filed: Jan. 27, 2023

(65) Prior Publication Data

US 2024/0254877 A1 Aug. 1, 2024

(51) Int. Cl.
*E21B 49/08* (2006.01)
*E21B 49/10* (2006.01)

(52) U.S. Cl.
CPC ..... *E21B 49/081* (2013.01); *E21B 49/10* (2013.01)

(58) Field of Classification Search
CPC ..... E21B 49/081; E21B 49/10
See application file for complete search history.

(56) References Cited

U.S. PATENT DOCUMENTS

| | | | |
|---|---|---|---|
| 3,880,233 | A | 4/1975 | Muecke et al. |
| 5,287,923 | A | 2/1994 | Cornette et al. |
| 5,829,520 | A | 11/1998 | Johnson |
| 8,342,240 | B2 | 1/2013 | Richard et al. |
| 10,329,908 | B2 | 6/2019 | Fox et al. |
| 11,371,137 | B2 | 6/2022 | Price et al. |

(Continued)

FOREIGN PATENT DOCUMENTS

| | | | |
|---|---|---|---|
| EP | 1091087 | A2 | 4/2001 |
| GB | 2448629 | B | 12/2008 |

OTHER PUBLICATIONS

International Search Report and Written Opinion for International Patent Application No. PCT/US2023/015181 dated Oct. 18, 2023. PDF file. 9 pages.

*Primary Examiner* — Robert E Fuller
(74) *Attorney, Agent, or Firm* — John W. Wustenberg; C. Tumey Law Group, PLLC

(57) ABSTRACT

A method and system for removing a filter cover. A system and method may comprise a downhole fluid sampling tool including a tool body; a flow port disposed on the tool body; a sample chamber disposed within the tool body and fluidly coupled to the flow port; a pump disposed within the tool body. In examples, the pump is configured to pump a fluid through the flow port into the sample chamber; a filter disposed on an inlet of the flow port, wherein the filter is configured to filter the fluid entering the flow port; and a removable filter cover configured to prevent fluid contact with the filter.

19 Claims, 4 Drawing Sheets

(56) References Cited

U.S. PATENT DOCUMENTS

| | | | | |
|---|---|---|---|---|
| 2006/0076132 | A1* | 4/2006 | Nold, III | E21B 49/10 166/264 |
| 2007/0039731 | A1 | 2/2007 | Fox et al. | |
| 2009/0084553 | A1* | 4/2009 | Rytlewski | E21B 43/08 166/305.1 |
| 2011/0023594 | A1 | 2/2011 | Pelletier et al. | |
| 2012/0250017 | A1 | 10/2012 | Morys et al. | |
| 2017/0122080 | A1* | 5/2017 | Bertani | E21B 43/14 |
| 2017/0269260 | A1 | 9/2017 | Chen et al. | |
| 2017/0284931 | A1 | 10/2017 | Perkins et al. | |
| 2019/0063215 | A1 | 2/2019 | Dai et al. | |
| 2019/0100995 | A1 | 4/2019 | He et al. | |
| 2022/0243588 | A1 | 8/2022 | Hudson et al. | |

* cited by examiner

PROTECTION OF A WELLBORE TOOL USING FLUID MEDIUM DEPENDENT MATERIAL

BACKGROUND

During oil and gas exploration, different types of information may be collected and analyzed. The information may be used to determine the quantity and quality of hydrocarbons in a reservoir and to develop or modify strategies for hydrocarbon production. For instance, collected information may be used for reservoir evaluation, flow assurance, reservoir stimulation, facility enhancement, production enhancement strategies, and reserve estimation.

Reservoir evaluation may utilize a downhole fluid sampling tool for collecting one or more fluid samples from one or more zones of interest in a subterranean formation. In some examples, the zone of interest may include a "pay zone" which includes reservoir fluids such as oil and gas in exploitable quantities. A zone of interest may be defined as a distinct region and/or measured depth within a wellbore or a region of the wellbore containing a fluid of interest.

A downhole fluid sampling tool may be conveyed through a wellbore penetrating the subterranean formation to reach the zone of interest within the subterranean formation. The downhole fluid sampling tool may perform reservoir evaluation by penetrating a wall of the wellbore, extracting a fluid sample from, and storing the fluid sample in a fluid sampling chamber. The fluid sampling tool may include one or more instruments for evaluating properties of the fluid sample. In some examples the fluid sample may be extracted from the fluid sampling chamber at a surface location to evaluate the properties of the fluid sample. Penetrating, extracting, and storing a fluid sample may be performed for one or more cycles at one or more zones of interest.

The fluid sampling tool may be conveyed into a wellbore which contains a wellbore servicing fluid, such as a drilling fluid. Wellbore servicing fluids may contact the downhole fluid sampling tool which may become contaminated with the wellbore servicing fluid. The contaminating fluid may impede reservoir evaluation tests, including the sampling of produced reservoir fluids.

BRIEF DESCRIPTION OF THE DRAWINGS

These drawings illustrate certain aspects of some examples of the present disclosure and should not be used to limit or define the disclosure.

DETAILED DESCRIPTION

Figure 1:
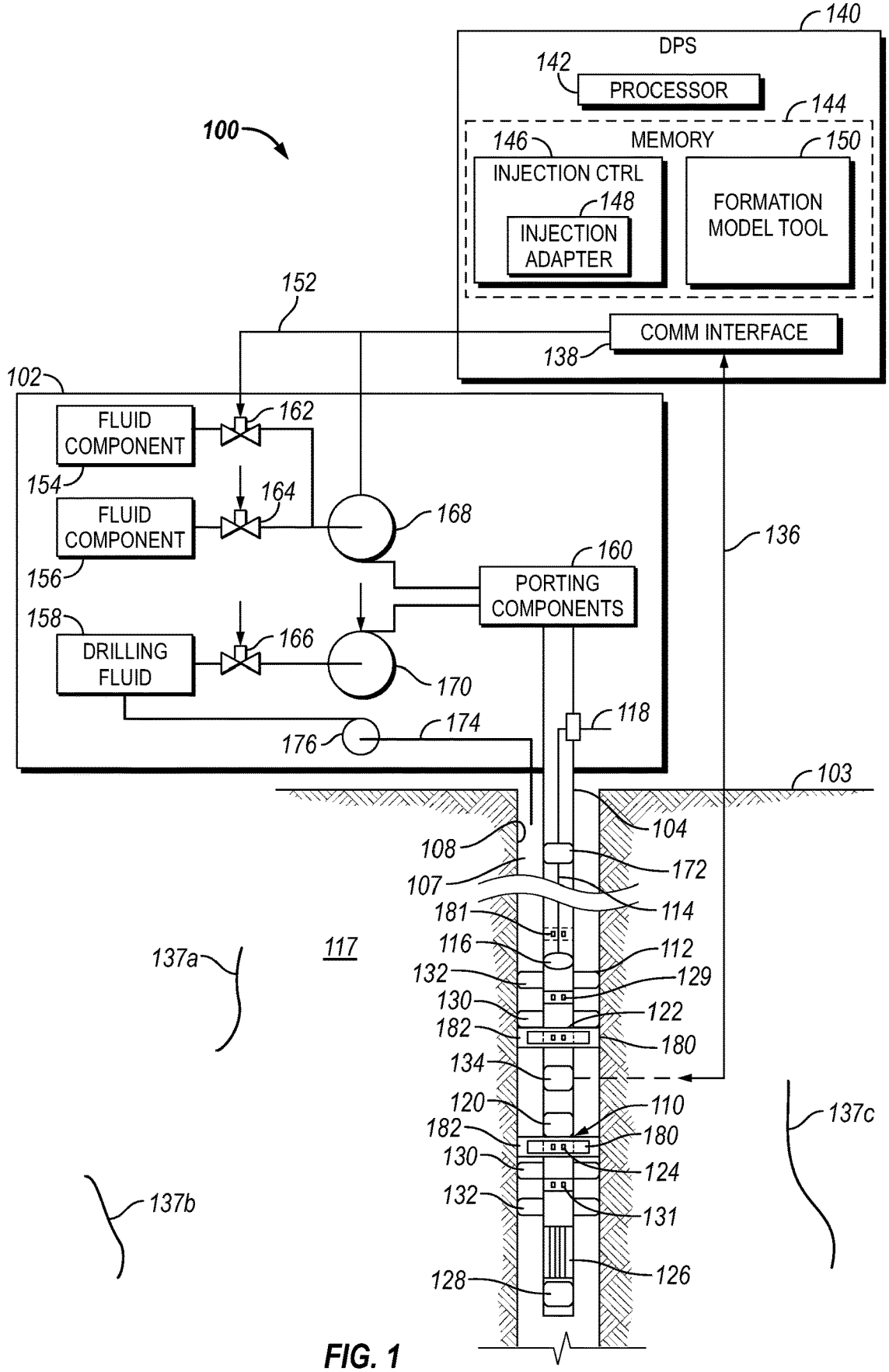
FIG. 1 illustrates an example reservoir test system.

This disclosure may be directed to methods and systems for protecting a downhole fluid sampling during conveyance through a wellbore. Methods and systems discussed below may incorporate a filter cover to protect the downhole fluid sampling tool from penetration and invasion of fluids present in the wellbore. Additionally, a filter cover may be configured to be operatively or designed to be naturally removed from the filter at a zone of interest in the wellbore where a reservoir evaluation test is to be performed. Removing the filter cover enables the downhole fluid sampling tool to receive fluid through the filter.

In some examples, a fluid pill of engineered fluid may be introduced into a wellbore servicing fluid, such as a drilling fluid, as the wellbore servicing fluid is introduced into the wellbore. A fluid pill may be defined as a relatively smaller volume of fluid than the wellbore servicing fluid, for example, 100 barrels or less, 50 barrels or less, 25 barrels or less, 10 barrels or less, or 5 barrels or less of fluid. The volume of the fluid pill may be selected to minimize interface mixing of the fluid pill with the fluid leading and the fluid following the fluid pill so that a relatively clean and known fluid is being used for a reservoir evaluation test. The fluid pill may be positioned in the wellbore where a reservoir evaluation test is to be performed. As will be discussed below, the engineered fluid may be utilized during a reservoir evaluation test by injecting the engineered fluid into a zone of interest for the subterranean formation and observing a response of the subterranean formation to the injected fluid. The reservoir evaluation test may be performed by a downhole fluid sampling tool, such as downhole fluid sampling tool 110 of FIG. 1. The fluid pill may be introduced into the wellbore before, during, or after the placement of a downhole fluid sampling tool into the wellbore.

The engineered fluid may include a base fluid and particulates to provide the engineered fluid with the required density to place the fluid pill into a desired position within a wellbore. In some embodiments, particulate added to the engineered fluid is such that the weight of the engineered fluid is in a range that is the same or substantially similar to the range of weight of wellbore servicing fluids present in the wellbore. Such a weight range can be defined such that the weight of the wellbore servicing fluid and the engineered fluid can prevent walls of the wellbore from collapsing and potentially preventing a blowout from the wellbore. In embodiments, the fluid pill may include weighting agents such as barite and/or calcium carbonate. Weighting agents may have a selected particle size range to aid in filtering from the engineered fluid before or during a reservoir evaluation test. For example, the weighting agent may have a particle size in a range of 1 micron to 1000 micron. Alternatively, from about 1 micron to about 250 micron, about 250 micron to about 500 micron, about 500 micron to about 1000 micron, or any ranges therebetween. In some examples, the base fluid may include, without limitation, water, brine, hydrocarbon fluids such as linear and branched alkanes, alkenes, alkynes, naphthenic compounds, polyalphaolefins, esters, mineral oils, aliphatic oils, silicone oils, perfluoro oils, and combinations thereof. In some examples, brines may include, without limitation sodium chloride (NaCl), calcium dichloride ($CaCl_2$)), potassium chloride (KCl), sodium bromide (NaBr), calcium bromide ($CaBr_2$), potassium bromide (KBr), potassium formate, zinc bromide, brines, and combinations thereof.

The particulate can include particles that can be filtered out from the customized injection fluid prior to injection into a subsurface formation for formation evaluation and testing. The engineered fluid for injection into the formation can prevent damaging or altering of the formation (which can adversely affect the accuracy of the evaluation and testing). Examples of such fluids to be used for injection can include brine, different types of oil-based fluids, etc. In some embodiments, suspension additives can be added to the fluid pill to reduce settling of the compositions in the fluid. Particles may further include material that is magnetic, weakly magnetic, or be magnetizable (e.g., para or ferro magnetic). For example, the particles can include iron. Such particles can then be magnetically filtered. In some embodiments, the particles can settle. The particles can then be separated using a downhole centrifuge, hydrocyclone, etc.

In some embodiments, the engineered fluid may include a pH control agent such as an acid or a base, such that the engineered fluid has a desired pH. In some examples the engineered fluid may be acidic having a pH in a range of about 3 to about 7 or may be alkaline having a pH in a range of about 7 to about 12. Examples of suitable pH control agents may include, but are not limited to, mineral acids, organic acids, Arrhenius acids, group I and group II metal hydroxides, and combinations thereof. In embodiments where the removable filter cover is pH sensitive or dissolvable in solutions with an acidic and/or alkaline pH, the pH of the engineered fluid may be selected such that the removable filter cover may be removed in the engineered fluid.

In embodiments, the engineered fluid may further include one or more of a viscosifying agent, a surfactant, a friction reducer, a clay inhibitor, a corrosion inhibitor, or combinations thereof. In some embodiments, the engineered fluid may contain a chemical component that may be used as a unique "tracer" to help distinguish the returned engineered fluid from formation fluids. In some cases, the tracer concentration may provide an indication of any dilution of the returned engineered fluid with the formation fluid. Also, the "tracer" component may be analyzed by spectrographic, electrical, optical or other means.

In embodiments multiple fluid pills comprising an engineered fluid may be introduced into the wellbore. The multiple fluid pills can be for one zone or multiple zones of the formation to be tested. The multiple fluid pills for one zone can be adjacent to each other and/or separated by a wellbore servicing fluid such as a drilling fluid. In some embodiments with multiple fluid pills for one zone, each fluid pill can be a separate customized injection fluid with different properties. In such embodiments, a same zone can be tested with each different engineered fluid to provide a more accurate evaluation of the reservoir. For example, each engineered fluid may have a different viscosity, a different flow rate, or other property. Alternatively, or in addition for embodiments with multiple fluid pills for a same zone, one or more fluid pills can include a fluid to clean the flow path into the zone prior to the injection test. For example, a fluid pill may include a surfactant to clean the flow path for the engineered fluid. A subsequent fluid pill having an engineered fluid can then be positioned in this same zone to be injected into the formation for formation testing and evaluation. The engineered fluid may be customized to maintain the initial formation rock wettability or alter the initial formation rock wettability. The engineered fluid may be designed to be miscible or immiscible with the formation fluid.

The composition of the engineered fluid is such that it is compatible with a continuous phase drilling fluid system. In some embodiments, the engineered fluid can be weighted with non-particulate matter such as salts for a water-based injection fluid.

Example embodiments use an injection tool disposed on a test string for injection of the engineered injection fluid into the formation. In some embodiments, the injection tool can be part of the drill pipe so that the drill pipe remains in the wellbore during testing. For example, the injection tool can be added to the end of the drill pipe and moved within the wellbore to the positions in the wellbore wherein injection tests are to be performed. Such embodiments may allow for multiple zones at different depths to be tested. After the fluid pill(s) are positioned in the zone to be tested, the drill pipe can be moved so that the injection tool is positioned in the zone to perform the test(s).

In some embodiments, the injection tool can be positioned on a wireline. In these embodiments, the fluid pill(s) can be flowed to the correct depth for the zone using a drill pipe. The drill pipe can then be removed and a wireline can be lowered in the wellbore so that the attached injection tool is at the correct depth for this zone.

A formation testing string can be configured with enough length between an isolation packer zone and filters to be on the test string such that the anulus of the wellbore (excluding the volume of the formation tester portion below the packer) can contain enough volume for an injection test. Also, the formation testing packer section can include a hydraulic mud line from the top of the packer section to the lower portion of the packer section, with sufficient flow capability for the viscosity of the mud present in the wellbore as to balance the injection rate of the formation injection reverse test. The pass through can then attach to additional sections above and below the packer section as necessary. In some embodiments, the pass through would be as short as possible. For example, the pass through can be limited to the packer section itself. Upon setting the packer and subsequently performing a mini-injection test with sampling and subsequently initiating injection, the fluid can flow through the filters and be replaced by the mud on the top portion of the fluid pill to drive the injection pressure.

A formation parameter that changes in response to injecting the injection fluid into the zone can be measured. For example, a fall off test can be performed by measuring a pressure in a zone as the pressure changes over time. The injection fluid can be at or near the hydrostatic pressure while the formation may be at some lower pressure. After the injection fluid flows into the formation and shut in, the pressure of the formation may be at or near the hydrostatic pressure. However, over time the pressure will return back to the formation pressure prior to the injection. This fall off of the pressure can then be used to determine a property of the formation.

Accordingly, example embodiments provide a reverse injection test such that an engineered fluid can be injected into the formation and the rate of decay of pressure can be measured to obtain formation characteristics. Such embodiments alleviate the environmental and safety concerns of conventional drill stem testing.

FIG. 1 illustrates an example reservoir test system, according to some examples of the present disclosure. A reservoir test system 100 may comprise subsystems, devices, and components configured to implement a two-stage fluid flow and testing procedure within wellbore 107. In FIG. 1, wellbore 107 is depicted as being an uncased, open borehole, but the methods, systems, and tools disclosed herein may be adapted for use in a cased hole embodiment. The reservoir test system 100 comprises a wellhead system 102 that comprises components for configuring and controlling deployment in terms of insertion and withdrawal of a test string 104 within the wellbore 107. The test string 104 may comprise multiple connected drill pipes, coiled tubing, or other downhole fluid conduit that may be extended and retracted using compatible drill string conveyance components within the wellhead system 102. In some examples, the wellbore or annular section of the wellbore may in part form the conduit as a fluid path from the surface to the bottom hole assembly (BHA). In some examples, the conduit may be formed in part by a combination of conduits.

The test string 104 may be utilized as the conveyance means for a downhole fluid sampling tool 110 that may be attached via a connector section 112 to the distal end of test string 104. For example, the downhole fluid sampling tool 110 may be attached such as by a threaded coupling to connector section 112, which may similarly be attached by threaded coupling to the end of the test string 104. Alternatively, the test string 104 may be lowered into position by wireline, slickline, coiled tubing, or moved into position by tractor. In addition to providing the means for extending and withdrawing the downhole fluid sampling tool 110 within the wellbore 107, the test string 104 and the connector section 112 form or comprise internal fluid conduits through which fluids may be withdrawn from or provided to the downhole fluid sampling tool 110. The test string 104 comprises fluid connectors and electrical connectors. The function of the fluid connectors and electrical connectors may be divided into more than one part, one for the electrical connection and one for the fluid connection. In the example for which the conveyance system may be the wireline and the upper flow portion of the fluid conduit may be the wellbore 107, the fluid connector may be disposed on the exterior of the test string 104 open to the wellbore 107 to draw fluid from the wellbore 107. In this example the wellbore 107 may be isolated at surface from atmospheric pressure, and the wellbore 107 pressurized to drive fluid to the downhole fluid sampling tool 110. The downhole fluid sampling tool 110 may comprise injection tool that may be positioned in a zone of interest with the fluid pill.

In embodiments, the downhole fluid sampling tool 110 may comprise filter 180 and removable filter cover 182. Filter 180 may include any suitable filter type for removing solids from fluids present in wellbore 107. Non-limiting examples of filters may include, screen filters, frit filters, mesh filters, slot filters, media filters, printed filters, or combinations thereof. Herein filter 180 may comprise holes 184 and/or a screen. Removable filter cover 182 is situated on sampling tool 110 to protect filter 180 from contact with wellbore fluids, including wellbore servicing fluids and pills of engineered fluids present in the wellbore, as the downhole fluid sampling tool 110 is placed in the wellbore 107. Removable filter cover 182 may be attached to, connected with, surrounding, or otherwise operably positioned relative to filter 180 such that fluids in wellbore 107 are prevented from contacting filter 180. Alternatively, or in addition to, removable filter cover 182 may be operably positioned such that a reduced amount of fluid in wellbore 107 contacts filter 180 as compared to if the fluid sampling tool 110 did not comprise the removable filter cover 182.

Once the downhole fluid sampling tool 110 is positioned in wellbore 107 in a desired position, removable filter cover 182 may be moved, removed, or otherwise caused to render fluid in wellbore 107 to be contacted with filter 180. Removable filter cover 182 may be moved or removed by any suitable means which may depend upon the specific design of the removable filter cover 182. In some embodiments, removable filter cover 182 may be moved or removed due to wellbore conditions such as temperature or pressure whereby the wellbore conditions cause the removable filter cover 182 to degrade, soften, or slough off, for example. Alternatively, removable filter cover 182 may be chemically removed by dissolution into a fluid present in the wellbore, or by reaction with components present in the wellbore fluid, such as hydrolysis by water, reaction with an acid or a base, or reaction with another compound present in the wellbore fluid. In further embodiments, the removable filter cover 182 may be removed electrically, such as by passing a current through the removable filter cover 182 which may cause the removable filter cover 182 to degrade and or otherwise become weakened and removed. In further embodiments, the removable filter cover 182 may be removed physically such as by scraping, prying, levering, pulling, or otherwise physically removing the removable filter cover 182 to allow for fluid contact with filter 180. Alternatively, the removable filter cover 182 may be positioned on an actuator such that the removable filter cover may be selectively moved. In a first position, the removable filter cover may be at a first position where the removable filter cover 182 is preventing fluid from contacting filter 180. In examples, removable filter cover 182 may be actuated (moved) to a second position by the actuator where the removable filter cover 182 is positioned out to allow fluid to contact filter 180. Such a removable filter cover 182 may include a thermoplastic and/or steel. Herein, a thermoplastic may be a substance that becomes plastic when heated and hardened when cooling and steel may be an alloy of at least iron and carbon. Further, the actuation may be performed by hydraulic pressure, pneumatic pressure, or electrical current. In further embodiments, the removable filter cover 182 may be degraded by enzymatic methods and/or by exposure to microbes present in the wellbore fluids or introduced into an engineered fluid pill.

Removable filter cover 182 may include any type of filter cover which fully or at least partially prevents filter 180 from contact with wellbore fluids, until the removable filter cover is removed. Removable filter cover 182 may include any suitable form factor to perform the function of preventing filter 180 from contact with wellbore fluids. For example, removable filter cover 182 may be a wrapping, covering, or coating, and may be flexible or solid. In embodiments, removable filter cover 182 may be in contact with filter 180. In further embodiments, removable filter cover 182 may be positioned such that the removable filter cover 182 and filter 180 are not in contact.

In some embodiments, the removable filter cover 182 includes a material which hydrolyses with water. Suitable hydrolysable materials may include, without limitation, polylactic acid, poly acrylamides, polyacrylic acid copolymers, polyethylene glycol, hydrolysable celluloses, hydrolysable chitosans, polycaprolactone, polyvinyl alcohol, aliphatic polyesters, polyorthoesters, poly(gly-colic acid), n-acylated linear poly(ethyleneimine)s, acrylic ester copolymers such as ethyl acylate copolymers and butyl acrylate copolymers, poly(trialkylsilyl methacrylate), poly(starch-g-((1-amidoethylene)-co-(sodium 1-carboxylatoethylene))), poly(1-amidoethylene), poly((R)-3-hydroxybutyrate-co-(R)-3-hydroxyvalerate), pectin esterase, hydrolysable polysaccharides, hydrolysable proteins, hydrolysable nucleic acids, and combinations thereof. In some embodiments, the engineered fluid may include a pH control agent such that the engineered fluid is acidic or alkaline to aid in hydrolysis of the hydrolysable material. In some embodiments, the hydrolysable material may include acid generating or alkaline generating components which produce an acid or alkaline component when exposed to water or other wellbore conditions.

In some embodiments, the removable filter cover may include a wax material which softens and/or melts at wellbore conditions. For example, petroleum-derived wax such as a paraffin wax and/or a polyethylene wax may be utilized as a removable filter cover. Alternatively, or in addition to petroleum-derived waxes, natural waxes such as carnauba wax, beeswax, spermacetic wax, or any other natural wax many be used alone or in combination with paraffin wax. Alternatively, or in addition to waxes, asphaltenes and/or tars may be utilized in combination or as a replacement for wax as a removable filter cover. The wax may be brushed onto filter 180 or poured into a mold and connected to filter 180, effectively sealing off filter 180 from contact with fluid as a removable filter cover 182. The paraffin wax may include paraffin waxes with different melting temperatures to tailor the paraffin wax to melt at a specific temperature within the wellbore.

In further examples, filter cover 182 may comprise a material disposed within a screen of filter 180. Further, the screen of filter 180 may be vibrated to break down the material within a screen of filter 180. Once the material within the screen of filter 180 has been broken down, fluid may flow through filter 180.

Communication and power source coupling are provided to the downhole fluid sampling tool 110 via a wireline cable 114 having one or more communication and power terminals within the wellhead system 102. In some examples, the wireline 114 may be connected to the downhole fluid sampling tool 110 following positioning of the downhole fluid sampling tool 110 within the wellbore 107. For instance, the connector section 112 may comprise a seating for a wet latch 116 that may be inserted into the test string 104 such as via a side entry flow portal 118. The wet latch 116 may comprise an elastomeric dart that may be attached to an end connector (not depicted) of the wireline 114. To connect the wireline 114 with the downhole fluid sampling tool 110, the wet latch 116 may be pumped downward through the test string 104 using a fluid medium such as drilling mud until the wet latch 116 seats within the connector section 112 resulting in the end connector of the wireline 114 electrically connecting to the downhole fluid sampling tool 110.

Downhole fluid sampling tool 110 further comprises measurement instruments 128 for measuring, detecting, or otherwise determining properties of the subsurface reservoir during injection testing. For example, the measurement instruments 128 may comprise one or more pressure detectors for determining reservoir fluid pressures within isolated or non-isolated flow portions of the wellbore 107. The pressure detector(s) within the measurement instruments 128 may comprise a pressure recorder for recording a pressure transient comprising pressure values measured over a time period such as a pressure rise or build up period following an intake flow and/or a pressure drop or fall off period following an injection flow. The measurement instruments 128 may further comprise a flow rate detector for measuring and recording flow rates of fluids injected from the downhole fluid sampling tool 110 into a reservoir 117. The measurement instruments 128 further comprise fluid properties detectors for measuring composition, fluid viscosity and compressibility and/or environment properties such as temperature and pressure.

The downhole fluid sampling tool 110 may be configured to communicate the measured fluid property values as well as injection test operation information to a surface data processing system (DPS) 140. The downhole fluid sampling tool 110 may directly communicate measurement and other information via the wireline 114 and/or via an alternate communication interface 134 such as but not limited to computer memory devices and systems. The downhole fluid sampling tool 110 may communicate to the DPS 140 via a telemetry link 136 using the communication interface 134 if, for example, the wireline 114 may be not comprised in the system or does not comprise a sufficient communication channel. The telemetry link 136 comprises transmission media and endpoint interface components configured to employ a variety of communication modes. The communication modes may comprise different signal and modulation types carried using one or more different transmission media such as acoustic, electromagnetic, and optical fiber media. For example, pressure pulses may be sent from the surface using the fluid in the drill pipe as the physical communication channel and those pulses received and interpreted by the downhole fluid sampling tool 110.

While depicted as a single box for ease of illustration, the DPS 140 may be implemented in any of one or more of a variety of standalone or networked computer processing environments. As shown, the DPS 140 may operate above a terrain surface 103 within or proximate to the wellhead system 102, for example. The DPS 140 comprises processing and storage components configured to receive and process injection test procedure and downhole measurement information to generate flow control signals. The DPS 140 may be further configured to process injection test data received from the downhole fluid sampling tool 110, such as pressure transient data, to determine permeability, physical extent, and hydrocarbon capacity of the reservoir 117. The DPS 140 comprises, in part, a computer processor 142 and a memory device 144 configured to execute program instructions for generating the flow control signals and the reservoir properties information. A communication interface 138 may be configured to transmit and receive signals to and from the downhole fluid sampling tool 110 as well as other devices within the reservoir test system 100 using a communication channel with the wireline 114 as well as the telemetry links 136 and 152.

DPS 140 may be configured to control various flow control components such as surface and downhole pumps and valves to enable coordinated transflow port, comprising initial engineered fluid mixing and fluid separation during transflow port to reservoir test sites within wellbore 107. Executing as loaded within memory 144, an injection controller application 146 may be configured to implement intake fluid flow testing in coordination with injection flow testing. Injection controller 146 may be configured using any combination of program instructions and data to process flow control system configuration information in conjunction with injection procedure parameters to generate the flow control signals. The flow control system configuration information may comprise pump flow capacities and overall fluid throughput capacities of the surface and sub-surface flow control networks. Injection controller 146 comprises an injection adapter application 148 that may be configured to modify flow control signals and/or generate engineered fluid component mixing instructions/signals based, at least in part, on fluid and reservoir properties measurement information generated and collected by downhole fluid sampling tool 110 such as during fluid intake testing.

Injection controller 146 may be configured, using a combination of program instructions and calls to control activation of flow control devices comprising a pair of pumps 168 and 170. Each of pumps 168 and 170 may be a fluid transfer pump such as a positive-displacement pump. Each of pumps 168 and 170 may be configured to drive fluid from a respective fluid source into and through test string 104 via flow porting components 160. In the depicted example, pump 168 may be configured to pump engineered fluid for injection testing, and pump 170 may be configured to pump drilling fluid, sometimes referred to as drilling mud, in flow port of drilling and reservoir testing operations. For some examples, in which base oil may be the engineered fluid, it may be supplied directly from the drilling mud system by the drilling mud pump 170. Base fluid, such as base oil, may be generated from the drilling mud by downhole filtration. In other examples, the drilling mud pump 170 may be used to supply fluids other than a drilling fluid for injection operations. In this manner, pump 170 may be substituted for pump 168 to supply engineered fluid during fluid injection operations. In such examples, pump 170 may connect directly to engineered fluid sources 154 or 156 in addition to connecting to drilling fluid source 158. The wellhead system comprises a recirculation line 174 driven by a recirculation pump 176 that recirculates the drilling fluid from wellbore 107 into drilling fluid source 158 such as when operating in drill mode and during downhole testing and sampling.

For examples in which the engineered fluid may be provided independently of the drilling mud system, pump 168 may be configured to receive fluid from one or more engineered fluid sources such as a first engineered fluid source 154 and a second engineered fluid source 156. Engineered fluid source 154 contains or otherwise supplies an engineered fluid having a different composition than the composition of fluid from fluid injection source 156. For example, the fluid supplied by engineered fluid source 154 may comprise a primary engineered fluid in the form of diesel, drilling fluid filtrate (oil or water or emulsion), and/or treated water such as treated sea water. Engineered fluid source 156 may supply a secondary, additive-type fluid having a relatively high or low viscosity and be mixed with the primary engineered fluid to form a viscosity adjusted engineered fluid mixture to be transflow ported downhole. Furthermore, additives may be mixed with one or both of fluid sources 154 and 156 to adjust the wettability characteristics of the engineered fluid. Pump 170 may be configured to receive fluid from a drilling fluid source 158, which may supply for example oil-based drilling mud. Pumps 168 and 170 are configured to drive fluid from a respective one or more sources into the fluid conduit formed by test string 104 via the flow porting components 160. One or multiple pumps may be configured in parallel or series with pumps 168 and/or 170 to achieve injection characteristics such as but not limited to injection pressure, flowrate and flowrate control. A throttling system may be used downhole within downhole fluid sampling tool 110, in the reservoir tester connector section 112, and/or within DPS 140 to control flow rate.

In some examples, reservoir test system 100 may be configured to obtain and utilize reservoir fluid as an optimally compatible engineered fluid for injection test operations. For example, reservoir fluid may be withdrawn into downhole fluid sampling tool 110 via flow ports 122 and/or 124 with flow control devices 120 configured for fluid intake. The reservoir fluid may be pumped or otherwise driven into a downhole containment volume that may comprise downhole fluid containers. Alternatively, the downhole containment volume may comprise the upper, non-isolated flow portion of wellbore 107 and/or the upper piping flow portion of test string 104. For example, the reservoir fluid may be pumped into the upper flow portion of wellbore 107 via flow ports 181 that are controllably opened and closed via valves (not depicted) within drill string 104.

Whether collected within downhole containers, the upper flow portion of test string 104, and/or the upper flow portion of wellbore 107, the reservoir fluid may be applied as the engineered fluid during reservoir pressure transient tests. If collected above downhole fluid sampling tool 110, for instance, the hydrostatic pressure head provides a pressure differential above reservoir pressure enabling the reservoir fluid to be injected back into the reservoir at a higher rate than withdrawn. In some examples, additional pressure may be applied by surface pumps 168 and/or 170 via flow porting components 160 to the fluid column within test string 104. If the reservoir fluid may be withdrawn from the same zone of interest for which it may be injected, then a wait time may be introduced to allow the reservoir pressure to reestablish steady state pressure between the withdraw and injection.

Each of pumps 168 and 170 may comprise a control interface (not depicted) such as a locally installed activation and switching microcontroller that receives activation and switching instructions from DPS 140 via telemetry link 152. For instance, the activation instructions may comprise instructions to activate or deactivate the pump and/or to activate or deactivate pressurized operation by which the pump applies pressure to drive the fluid received from a response of the fluid sources into and through test string 104. Switching instructions may comprise instructions to switch to, from, and/or between different fluid pumping modes. For instance, a switching instruction may instruct the target pump 168 and/or 170 to switch from low flow rate (low pressure) operation to higher flow rate (higher pressure) operation.

By issuing coordinated activation and switching instructions to pumps 168 and 170, DPS 140 controls and coordinates flows and flow rates of fluids from each of fluid sources 154, 156, and 158 through test string 104. Additional flow control, comprising individual control of flow from the fluid sources 154, 156, and 158 to pumps 168 and 170 may be provided by electronically actuated valves 162, 164, and 166. Each of valves 162, 164, and 166 comprises a control interface (not depicted) such as a locally installed microcontroller that receives valve position instructions from DPS 140 via telemetry link 152. For instance, the valve position instructions may comprise instructions to open, close, or otherwise modify the flow control position of the valve. Individually, or in combination with pump operation instructions, DPS 140 may control pressure and rate of flow from each of fluid sources 154, 156, and 158.

The components of reservoir test system 100 are configured to implement inflow and injection flow testing from which properties such as but not limited to reservoir mobility, permeability, porosity, rock-fluid compressibility, skin factor, anisotropy, reservoir geometry, and reservoir extent are determined. As shown, hydrocarbon reservoir 117 comprises physical discontinuities 137 *a*, 137 *b*, and 137 *c*, each representing either a reservoir edge or an internal reservoir discontinuity such as but not limited to a fault or low permeability zones of interest that manifests as a pressure and/or fluid flow barrier. Traditional DSTs entail fluid intake flow rate and pressure transient testing to locate reservoir edges and internal reservoir discontinuities. However, logistical, safety, and environmental issues limit the rate at which fluid may be withdrawn such as by reducing wellbore pressure to induce inflow. Therefore, fluid intake test typically requires large volumes of fluid be withdrawn at relatively low flow rates, resulting in substantial expense in terms of equipment overhead and otherwise to capture and contain the withdrawn reservoir fluid content.

In some examples, reservoir test system 100 addresses issues posed by traditional DST by implementing a dual phase reservoir test cycle in which a fluid inflow test phase precedes and facilitates a subsequent fluid injection phase. A reservoir test cycle may begin with drill string position components (not depicted) within wellhead 102 extending or retracting test string 104 to position downhole fluid sampling tool 110 at a reservoir test site within wellbore 107. With downhole fluid sampling tool 110 positioned, components such as a pump within flow control devices 120 deploys a pair of isolation packers 140 such as by inflating packers 140 to form hydraulic and pressure barriers to wellbore fluid above and below a zone of interest formed between isolation packers 140. In some examples, the system may comprise an additional one or more packers such as buffer packers 142 that are deployed to form additional hydraulically isolated buffer zones to facilitate reservoir testing such as by providing a buffer to, for example, prevent or reduce pressure noise that may otherwise interfere with measurements within the zone of interests of interest. Buffer packers 142 may not make hydraulic contact with the reservoir (inside wall 108 of wellbore 107) and are pressurized above reservoir pressure above or below hydrostatic pressure. With buffer packers 142 deployed, pressure zones are formed in the wellbore space between packers 140 and 142. In the depicted example, flow ports 129 and flow ports 141 which may comprise intake probes, are disposed between the upper and/or lower buffer packers 142 and the upper one of isolation packers 140 and may be used for fluid intake and/or fluid injection. Additionally, one or more probes may be used independent of buffer packers.

Following positioning of downhole fluid sampling tool 110, prior or subsequent to deployment of packers 140 and 142, wet latch 116 may be pumped down to connector section 112 where it seats and effectuates connectivity of wireline 114 with downhole fluid sampling tool 110. Test string 104 may contain drilling fluid prior to pumping down of wet latch 116. In some examples, wellhead system 102 may be configured to pump wet latch 116 down to connector section 112 using engineered fluid such as from engineered fluids source 154 and/or 156. Wet latch 116 may comprise a sealing plug such as a piston plug to separate the engineered fluid (e.g., diesel) from the drilling fluid with test string 104. In some examples, wet latch 116 may comprise an elastomeric body member having brush contact edges or other soft elastomeric edges to form a substantially fluid impermeable seal against the inner conduit surface of test string 104. In this manner, wet latch 116 in addition to implementing wireline connection performs a conduit flushing function by flushing the drilling fluid out of test string 104 through an exit flow port provided by flow ports 122 or 124. In other examples, the conveyance system may be the wireline, and therefore a wet latch may be not used as the connector. In yet other examples, the drilling fluid mud may be filtered at the BHA to provide drilling fluid base oil as an engineered fluid. For this example, the wellbore may form in part the conduit. The BHA in this example would contain a filter section to produce a fluid that in part contains drilling fluid base oil.

Although the primary function of the DST BHA comprising downhole fluid sampling tool 110 and connector section 112 may be to facilitate the injection of fluid into the reservoir, it may be configured to facilitate fluid inflow into the tool, such as for the purpose of cleaning the wellbore or for performing measurements on the reservoir fluids. Such capability may be provided by components such as pumps and valves. Reversible pumps may be used such that the same pump may be used for either outflow into the wellbore and inflow from the wellbore into the tool.

Following establishment of the isolated test and buffer zones and connection of wireline 114, downhole fluid sampling tool 110 and other components within reservoir test system 100 may implement a reservoir test preparation phase to optimize fluid intake testing particularly if wellbore 107 may be an open borehole. Such test preparation phase may involve testing the injectability of the reservoir by pumping fluid into the wellbore or testing the permeability of the reservoir by drawing in fluid from the wellbore. For example, wellhead system 102 such as may be controlled in part by DPS 140 in combination with a downhole pump within downhole fluid sampling tool 110 may drive engineered fluid into the zone of interests of interest with mud cake intact on an inner surface 108 of wellbore 107 in order to measure the leak rate of the filter cake. For example, the leak rate may be determined by relatively small-scale injection and/or withdrawal of fluid from wellbore over a specified period and measuring the rate of fluid transfer to provide in situ information about the permeability of the wellbore mud cake layer.

The leak rate of the filter cake may be utilized to optimize subsequent drilling operations at or proximate wellbore 107 to optimize acquisition of reservoir fluid samples during the fluid intake test phase, or to help establish a cleaning program for removing the mud cake to facilitate injection. The fluid properties measured during the fluid intake phase may be used to extrapolate clean reservoir fluid properties as well as drilling fluid filtrate contamination levels such that fluid sampling and analysis begins at a point during fluid intake at which the fluid may be relatively free of borehole contaminants. Further, the leak rate of the filter cake may be a significant parameter in interpreting the data from the fluid injection test in order to determine reservoir parameters such as but not limited to barriers to flow within the reservoir, reservoir extent, reservoir geometry, permeability, porosity and anisotropy.

The fluid inflow test phase may be performed with test string 104 containing engineered fluid with wet latch 116 acting as a flushing plug that separates the drilling fluid initially contained in test string 104 from the engineered fluid. The drilling fluid may be swept out of test string 104 via flow ports 122, 129, and/or 124. If the fluid intake test may be performed on a different test cycle, or with drilling fluid filling test string 104, another piston plug 172 may be used to separate the drilling fluid from the engineered fluid as the engineered fluid sweeps test string 104. Each of piston plug 172 and subsequent piston plugs comprise a center hole through which wireline 114 passes as the plug may be pumped downhole to plug receptacles within connector section 112 and/or downhole fluid sampling tool 110. A fluid such as a fluorocarbon that may be neither soluble in water nor oil fluids, or the like, may also be used to separate the engineered fluid from the filter cake and drilling fluid. In some examples, the selected fluid has a density between that of the engineered fluid and the drilling fluid, and not be soluble in either the engineered fluid or the drilling fluid.

To clean the zone of interests of interest and/or downhole fluid sampling tool 110 prior to the fluid intake test, a pump within flow control devices 120 may be actuated to flush downhole fluid sampling tool 110 with the engineered fluid. The zone of interests of interest (i.e., annular space between packers 140 that makes hydraulic contact with the inner wall 108 of wellbore 107) may also be flushed with engineered fluid to optimize subsequent intake and engineered fluid testing. This may remove the filter cake from the region of wellbore 107 within the zone of interests of interest. This flushing of the tool and zone of interests of interest entails injecting engineered fluid and evacuating fluid from the zone of interests of interest. The flushing may be accomplished by pumping the engineered fluid into the zone of interest and evacuating the resultant mixture at the top or bottom positions within the zone of interests of interest determined by fluid density. If the engineered fluid may be less dense than the drilling fluid, for example, atop down flushing of the drilling fluid and filter cake may be implemented by injecting nearer the top (e.g., from flow ports 122) and evacuating nearer the bottom (e.g., into flow ports 124). Alternatively, the zone of interests of interest may be cleaned with fluid from reservoir 117 in the process of a fluid intake test. In this example, reservoir fluid may be withdrawn from reservoir 117 thereby clearing the filter cake from the walls of the wellbore within the zone of interests of interest prior to the fluid injection test. Fluids drawn into downhole fluid sampling tool 110 may be expelled into the annulus section of the wellbore above the zone of interests of interest, in the annulus below the zone of interests of interest, in a storage container within downhole fluid sampling tool 110 or driven up through test string 104 for temporary storage.

In the absence of or following the preliminary zone of interests of interest flushing, the fluid intake phase of a reservoir test cycle begins with downhole fluid sampling tool 110 actuating one or more of flow control devices 120 such as a fluid intake valve. The valve actuation alone or in conjunction with negative pump pressure implements negative pressure within the zone of interests of interest between packers 140 that induces flow of reservoir fluid into downhole fluid sampling tool 110 such as via flow ports 122 or 124. During and following fluid intake downhole fluid sampling tool 110 performs fluid and reservoir properties testing. The fluid properties to be determined comprise composition, contamination level (with respect to drilling fluid filtrate), viscosity, compressibility, bubble point, and gas-to-oil ratio. The engineered fluid may be tested using downhole sensors to determine fluid properties such as viscosity, density and or composition. The engineered fluid may also be sampled downhole so that fluid properties may be later determined. The viscosity value determined in situ or from the sampled fluid may be used in combination with one or more pressure sensors to determine flow rate of the engineered fluid at various stages throughout the injection testing.

Alternatively, a known pump rate may be used to calibrate two pressure gauges at different positions within the flow line of the BHA in order to directly measure flow rate. Such a measurement may be improved by having a known engineered fluid density, the height difference of the two different pressure sensors, and a zero flow reference to normalize the two pressure gauges. In some examples, downhole fluid sampling tool 110 determines fluid properties such as temperature and pressure by directly measuring using measurement instruments 128. Measured pressures may comprise sand face pressures within the zone of interests of interest and are used to determine a pressure rise transient determined over a period during and/or following the termination of the withdrawal of fluid from the zone of interests of interest. The pressure transient may be processed by components within downhole fluid sampling tool 110 and/or DPS 140 to determine near wellbore properties such as reservoir mobility or permeability. Pressures within the isolated buffer zones formed between packers 140 and 142 may also be measured to optimize computation of the zone of interests of interest pressures by, for example, cancelling low frequency pressure interference generated above and below the barrier zones. Methods for canceling such interference noise from outside the zone of interests of interest comprise but are not limited to autocorrelation techniques, or a physical mode fit of the location-based pressure measurements. These types of zone of interests of interest pressure measurement correction may also be implemented to correct pressure measurements performed for a corresponding fluid injection test.

Pressure measurements between the packers may account for effects such as deformation of the packers, in order to better determine reservoir properties. During the fluid inflow test a sample or samples may be acquired for subsequent laboratory analysis. Fluid intake tests may be performed within wellbore 107 at multiple locations, to find a suitable location for a fluid injection test, or to map the fluid variation within a reservoir to be used to better interpret reservoir properties from the injection test. Samples may be acquired form these multiple locations and/or at different stages of the fluid intake test at the different locations such as by flow ports 129 from the isolated buffer zone of interest. Monitoring of the fluid properties may take place as a function of time or as a function volume of fluid flowed in. The fluid properties measured at different stages (for instance time based or volume based) of the fluid intake test may be interpreted to provide fluid properties of the clean representative reservoir fluid properties. Such an interpretation may be performed by extrapolating the fluid properties according to a model which describes the inflow test as a function of time or volume or interpreted with equation of state techniques during a single inflow test or across multiple inflow tests.

Samples of the reservoir fluid maybe taken. Samples of the inflow fluid may be taken. Also, core samples of the rock from the injection site for the zone of interest, near the injection site for the zone of interest, or from proxy reservoirs representing the injection site for the zone of interest may be taken either before or after injections. Such core samples may be used to determine rock parameters such as but not limited to capillary pressure curves, saturation curves, or relative permeability curves regarding the reservoir fluid and engineered fluid. Core samples may be tested directly with the fluid samples of engineered fluid and reservoir fluid, or appropriate fluid proxies may be used. Such core measurements may be useful in determination of reservoir properties, especially in mixed phase systems. Further wettability effects may be tested on the cores with regards to the sampled or proxy fluids. Other methods of testing the rock may utilize rock cuttings from the zone of interest, near the zone of interest or from proxy reservoirs representing the zones of interest. Further other methods of testing the rock may utilize digital rock calculations based on down hole or surface rock properties, comprising but not limited to down hole petrophysical logs such as electromagnetic logs, NMR logs, acoustic logs and nuclear logs. Such rock properties, fluid properties, and interactive rock and fluid properties may be used as part of an analytical model or digital model or proxy model such as but not limited to a machine learning proxy model, in order to invert reservoir and reservoir properties from the injection test.

Measurement instruments 128 may also perform fluid content analysis to determine properties such as viscosity, compressibility, and chemical composition. Measurement instruments 128 further comprise components configured to determine and record a pressure transient such as a pressure rise during and/or following the period over which reservoir fluid may be withdrawn into downhole fluid sampling tool 110. The pressure transient information may be processed by processing components within measurement instruments 128 to calculate or otherwise determine a reservoir mobility, permeability, and/or anisotropy. Anisotropy measurements require a second probe distal to the zone of interests of interest and separate from the isolated buffer zones of interest(s). Alternatively, the pressure transient information may be transmitted to DPS 140, which comprises components such as reservoir model tool 150 that are configured to determine reservoir permeability based on the pressure transient information.

Prior to a fluid injection test phase, the fluid and reservoir properties data comprising a combination of reservoir pressure and permeability and fluid composition, fluid viscosity, and fluid density are processed by DPS 140 to optimize the engineered fluid composition and fluid injection parameters such as injection pressure and flow rate. Regarding engineered fluid composition, injection controller 146 and injection adapter 148 are configured to select or generate by mixing, an engineered fluid having a viscosity and/or a density and/or a wettability that matches reservoir fluid viscosity and/or density and/or wettability to within a threshold. Wettability for instance may be adjusted in order to match the expected wettability characteristics of the reservoir for instance if prior reservoir information may be obtained, or adjusted based on the composition of the reservoir fluid, for instance from saturates, aromatics, resins, and asphaltene (SARA compositor) data.

In response to one or more of the received fluid and reservoir properties values including, for some examples, the values such as exceeding a threshold, injection controller 146 calls or otherwise executes injection adapter 148 to cause injector 148 to generate an adapted injection procedure. The injection procedure may specify an engineered fluid composition which may comprise a combination of components from fluid sources 154 and 156 that most nearly matches the reservoir fluid viscosity. In addition to viscosity matching, injection adapter 148 may be configured to select or generate by mixing an engineered fluid that matches other reservoir fluid properties such as density and salinity. For instance, if the engineered fluid comprises salt water such as seawater, sulfate may be removed and/or other ions may be removed to prevent scale, swelling, or other reservoir damage. Scale inhibition components may also be added to the engineered fluid. Oil based engineered fluids such as but not limited to diesel or drilling fluid base oil, may contain compounds to prevent the precipitation of asphaltenes within the reservoir. One such compound may be d-limonene, however, other compounds that exhibit scale inhibition may be utilized. Engineered fluid containing in part base oil may be generated from drilling fluid by filtration. In other examples, engineered fluid may be carried downhole in containers as part of the BHA.

In addition to regulating engineered fluid composition, components within wellhead 102, DPS 140, and/or downhole fluid sampling tool 110 are configured to determine the flow rates and flow pressures applied during the fluid injection test phase. For instance, injection controller 146 and injection adapter 148 may be configured to determine and implement a fluid injection procedure that applies a flow rate and/or flow pressure that may be modified from a default flow rate/pressure based on reservoir permeability and other reservoir and fluid properties measured or otherwise generated by the fluid intake testing. Injection controller 146 may apply other parameters to limit or otherwise determine flow rates and pressures. For example, injection controller 146 in conjunction with components in wellhead 102 and downhole fluid sampling tool 110 may set and maintain the injection flow rate and/or flow pressure below the fracture pressure of reservoir 117 and further to remain below the static wellbore pressure within the zone of interests of interest.

Based on the adapted injection procedure, pump and valve control signals are transmitted via communications interface 138 to the control interfaces of pumps 168 and 170 and valves 162, 164, and 166 to implement coordinated flow of fluids from fluid sources 154, 156, and 158 through test string 104 at specified flow rates and/or pressures. Flow control components 120 within downhole fluid sampling tool 110 may be utilized to facilitate implementation of the specified flow rates and pressures such as by flow rate and/or flow pressure throttling. Additionally, or in the alternative, flow rates and pressures may be controlled by directing the engineered fluid to one or more pumps within downhole fluid sampling tool 110 that may regulate flow rate locally. In some examples, measurement instruments 128 and flow control components 120 may operate in conjunction to maintain relatively precise downhole control of the flow rates and pressures. For instance, measurement instruments 128 may comprise components for measuring the engineered fluid flow rate and or flow pressure and one or more of flow control components 120 such as pumps and adjustable valves may be configured to modify flow rate and/or pressure accordingly. Such throttling control functionality may be implemented by flow control devices such as pumps, valves, and local controllers within downhole fluid sampling tool 110. The flow rate measurement may be calibrated downhole using the known flowrate of a pump for an engineered fluid. The calibration may comprise at least one of a single known flow rate, a static measurement (no flow), and/or multiple known flow rates. The flow rates comprising a static measurement may be achieved with a pump such as a metered pump for reference. Thereby if at a later time the pump may be bypassed, the flow measurement still provides a in situ calibrated value. The flow device may comprise the combination of two pressure gauges at two different locations within the flow line of the BHA. If two pressure gauges are used, a measured or known density of the engineered fluid may be utilized to correctly account for gauge offset.

Injection controller 146 may be configured to begin the injection procedure following a fluid intake phase or otherwise when the reservoir fluid pressure within the zone of interests of interest returns to steady-state reservoir pressure. The steady-state pressure condition may be determined by downhole fluid sampling tool 110, which may transmit a corresponding signal to DPS 140. To implement and regulate the pressurized application of the engineered fluid, flow control and engineered fluid selection/mixing instructions generated by injection controller 146 are transmitted to corresponding flow control components. In response to the instructions, the flow control components, such as pumps 168 and 170 and valves 162, 164, and 166 drive instruction-specified quantities of fluids from fluids sources 154, 156, and 158 into test string 104 at instruction-specified intervals corresponding to specified injection volumes. The fluids are transflow ported via test string 104 into and through flow conduits and outlet flow ports within downhole fluid sampling tool 110. The injection flow rate may be maintained at a constant rate, which if not feasible, may be compensated for during post-processing using reservoir model tool 150.

The volume of engineered fluid applied during the fluid injection test may depend on reservoir properties with respect to the intended reservoir extent to be monitored and the accuracy of the pressure detectors (e.g., pressure gauges) within downhole fluid sampling tool 110. For example, in 1000 millidarcy (md) reservoirs having fluids at approximately 0.5 centipoise (cp), approximately 175 barrels of engineered fluid may be required to detect pressure/permeability barriers such as barriers 137 *a*-137 *c*, positioned up to 500 meters from the wellbore. This calculation may depend on the type of reservoir model used and may be analytically estimated or estimated by forward modeling simulations such as may be performed by a numerical reservoir modeling tool 150. The volume calculation may also be determined based on empirical methods or analogous comparison to offset wells located within a specified distance.

During injection of the engineered fluid through test string 104 as throttled by downhole fluid sampling tool 110, the flow rate and wellbore pressure within the zone of interest are measured by measurement instruments 120. Injection concludes with a sudden stoppage of the engineered fluid flow with secondary plug 172 released from a surface holder into test string 104. Secondary plug 172, like wet latch 116, may comprise brush contacts or elastomeric contacts at its outer edges that contact the inner surface of the conduit within test string 116 and brush contacts or elastomeric contacts on the edge of the center hole through which wireline 114 passes. In this manner, secondary plug 172 keeps the engineered fluid separate from driving secondary plug 172 in order to sweep test string 104 free of the engineered fluid. In some examples, the action of secondary plug 172 reaching the bottom of wet latch 116 would both stop the flow of engineered fluid into the reservoir and divert the drilling fluid flow into the annular region outside test string 104 and downhole fluid sampling tool 110. Downhole fluid sampling tool 110 transmits a signal to DPS 140 to initiate the substantially simultaneous deactivation of pumps 168 and 170.

In some examples multiple plugs may be used to separate multiple engineered fluids. The plugs may be pre-loaded into the conduit system and deployed on demand. Alternatively, a liquid plug may be used in vertical or deviated wells. Such a liquid plug may have the advantage that it may be more easily deployed on demand and without substantial limit to the number of plugs used. Such a liquid plug would preferably have a density between that of the drilling fluid and the engineered fluid, or between densities of subsequent engineered fluids. The ideal fluid would not be soluble in either fluid being separated. Examples of such fluids comprise fluorocarbons, oils, or water. The density of such liquids may be adjusted to meet the specified criteria. The density of water may be raised with salts or lowered with compounds such as salts comprising organic salts, or highly water-soluble organic compounds such as methanol, other alcohols.

Following stoppage of fluid injection, a pressure transient within the zone of interests of interest in the form of a pressure fall may be detected and recorded by measurement instruments 120. Specifically, pressure at the sand face within the zone of interests of interest will decrease toward reservoir pressure as the engineered fluid dissipates within the reservoir. The pressure drop information may be transmitted by downhole fluid sampling tool 110 to DPS 140 and processed by reservoir modeling tool 150 to determine reservoir properties such as reservoir permeability and flow discontinuities (also referred to as pressure discontinuities or permeability discontinuities) such as discontinuities 137 *a*-137 *c*.

Formation model tool 150 processes the pressure drop transient detected subsequent to injection similar to the processing of pressure rise information for the intake test but with a fluid (the engineered fluid) that may be not an exact match in terms of one or more properties such as viscosity and density with the reservoir fluid. By minimizing the differences, particularly in viscosity, between the engineered fluid and the reservoir fluid, the mathematical processing becomes increasingly similar to that of a fluid intake DST. However, forward modeling a reservoir simulation may allow interpretation of the pressure rebound to comprise differences in fluid properties. In some examples, laboratory data from the sampled fluid from the fluid intake test or another source may provide more accurate fluid properties with which to interpret the fluid intake test reservoir properties results. A fluid compositional gradient defined by reservoir testing data, or multiple reservoir testing samples, may also be used with forward model reservoir simulations in order to more accurately interpret the extent of the reservoir and internal reservoir flow barriers based on the determined permeability/pressure barriers. The gradient also may provide possible near wellbore damage (skin effect). Forward modeling may comprise analytical test design and interpretation of pressure derivative and superposition plot or numerical simulation of the whole process. Combining all data into numerical and analytical modeling also provides an overall estimate of the well performance (injectivity/productivity) and possible fluid displacement dynamic near the wellbore.

While reservoir test system 100 may be described as being deployed for determining reservoir properties such as permeability, capacity, and naturally occurring discontinuities such as reservoir boundaries and internal material discontinuities, it should be noted that system 100 may also be operable for fracture analysis testing in which a fracture may be intentionally created and tested. Such procedures are typically called a minifrac and may be analyzed using leakoff or flowback pressure transients to determine the fracture initiation, propagation, closure pressure (minimum horizontal stress), fracture half-length, and other reservoir properties such as permeability.

In some examples, downhole fluid sampling tool 110 comprises a fluid intake flow port comprising a probe located outside as well as within the zone of interests of interest. For example, a monitor probe may be located along wellbore 107 within one of the barrier zones between one of packers 140 and a proximate one of packers 142. Prior to injection of the engineered fluid within the zone of interests of interest, the isolated buffer zone containing the monitor probe may be primed to make hydraulic contact from with the reservoir that may be a difference from the isolated buffer zone that may be not primed. Differential pressure information obtained from the monitored buffer zone and the zone of interest may be processed by components of downhole fluid sampling tool 110 and/or DPS 140 to measure or otherwise determine reservoir anisotropy during or after the fluid injection test.

Isolated buffer zone between the packers 140 and 142 may be monitored (such as by measurement instruments) to measure properties of fluid withdrawn by the flow ports 129 to detect pressure transients. This may require an initial test to determine a pressure difference between at least one of the buffer zone and the zone of interest with an injection of fluid followed by a shut-in to establish hydraulic communication with the reservoir. Once the pressure has stabilized in the buffer zone(s) and the zone of interest, the extended injection test may start. During the extended injection, testing the pressures in the isolated buffer and test zone of interests may be monitored to determine additional reservoir properties such as permeability anisotropy or near well bore structures such as layering and vertical flow barriers. Additional tests may be performed in the isolated buffer and test zones before or after the extended injection test and the pressures monitored in all zones for further analysis.

Downhole fluid sampling tool 110 may comprise components configured to implement fluid intake testing that facilitates the fluid injection testing. Downhole fluid sampling tool 110 may comprise flow control devices 120 for implementing and regulating inflow of reservoir and other fluids into the downhole fluid sampling tool 110 and outflow of drilling fluids, injection test fluids, and borehole cleaning fluids from the downhole fluid sampling tool 110. For example, the flow control devices 120 may comprise a combination of one or more valves and/or pumps mutually configured to provide flow pathways and flow inducement pressures for withdrawing reservoir fluids into the downhole fluid sampling tool 110 from the annular region of the wellbore 107 surrounding the downhole fluid sampling tool 110. Flow control devices 120 may intake fluid from and inject fluid into the annular wellbore region via a set of one or more flow ports 122 within the connector section 112 and flow ports 124 within the downhole fluid sampling tool 110 itself.

In some examples, the flow ports 122 and 124 may be configured as orifices disposed at the body surface of the connector section 112 and the downhole fluid sampling tool 110, respectively. Flow ports 122 and 124 may be represented as isolation packers 140 and 142 as open orifices exposed within the wellbore 107, extendable probes employed by wireline, or any employment of a flowline configured to allow fluids to flow into downhole fluid sampling tool 110. There may be any number of flow ports 122 and 124 with any configuration of probes. In addition, or alternatively, the flow ports 122 and 124 may be configured as outwardly extending probes having a flow port positioned on or driven within an inner borehole surface 108 of the wellbore 107. In examples, flow ports 122 and 124 may comprise more than one packer and/or probe implementations, to be discussed below. Further, flow ports 122 and 124 may be connected to filter 180. Filter 180 may be protected by removable filter cover 182.

Figure 2A:
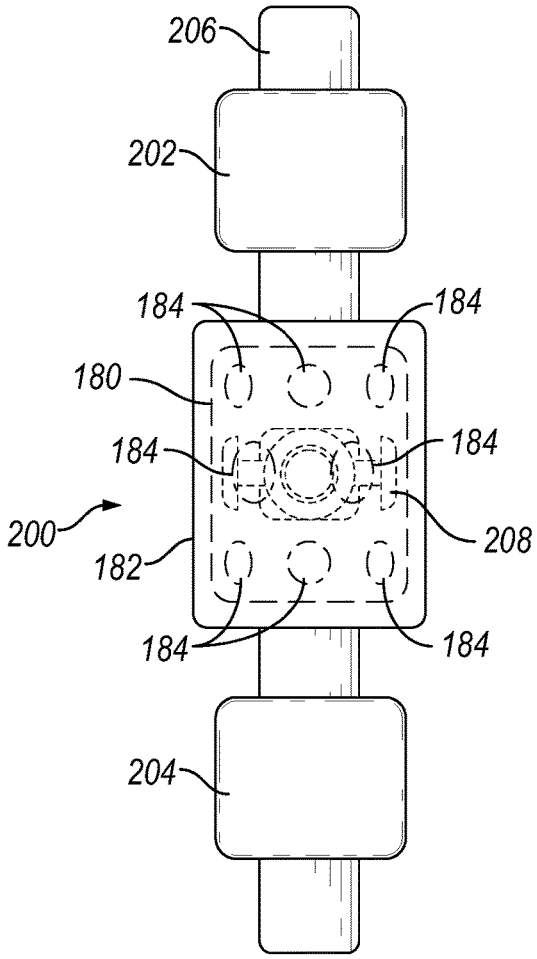
FIG. 2A illustrates a layered example of a probe assembly with filter and removable filter cover.

FIG. 2A illustrates a layered example of a probe assembly 200 with filter 180 and removable filter cover 182. As illustrated in FIG. 2A, flow ports 122 and 124 (e.g., referring to FIG. 1) comprise probe assembly 200 with a dual self-sealing probe 208. Herein, one or more probes may be utilized in probe assembly 200. For example, probe assembly 200 may comprise dual probes, a single probe, a focused probe, a packer, or multi probe section with shapes defined to seal against the wellbore comprising but not limited to circular probes, oval probes, elliptical probes, elongated probes, packer probes, and/or radial probes. Probe assembly 200 includes removable filter cover 182 such as those previously described which minimize or prevent wellbore fluid contact with filter 180. Filter 180 may include any suitable filter, including those previously described. Additionally, packers 202 and 204 may be deployed on tool body 206. Packers 202 and 204 may be inflatable packers, swellable packers, or any other suitable packers for isolating a portion of the wellbore. Tool body 206 may further include an electrical bus (not illustrated). In this example, dual self-sealing probe 208 may be radially extended to a zone of interest between the inflatable packers 202 and 204. As discussed above, probe assembly 200 may be deployed without packers. Further, there may be any number of probe assemblies 200, each comprising filter 180 and removable filter cover 182.

Figure 2B:
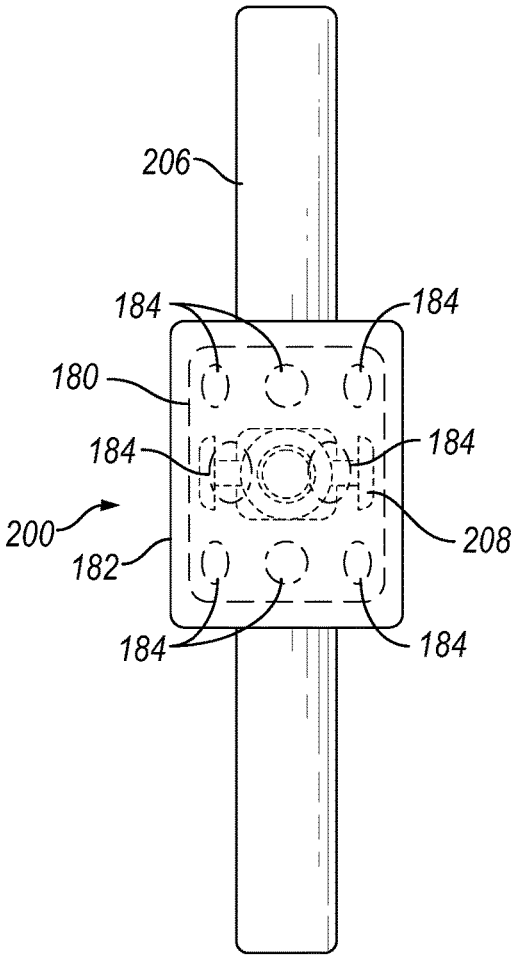
FIG. 2B illustrates probe assembly without the application of packers.

As previously described, removable filter cover 182 may be configured to be operatively or designed to be naturally removed from the filter at a zone of interest of interest as described above. Once removable filter cover 182 is removed, filter 180 may allow fluids into flow ports 122 and 124, while filtering out particulates. FIG. 2B illustrates probe assembly 200 without the application of packers 202 and 204.

Figure 3A:
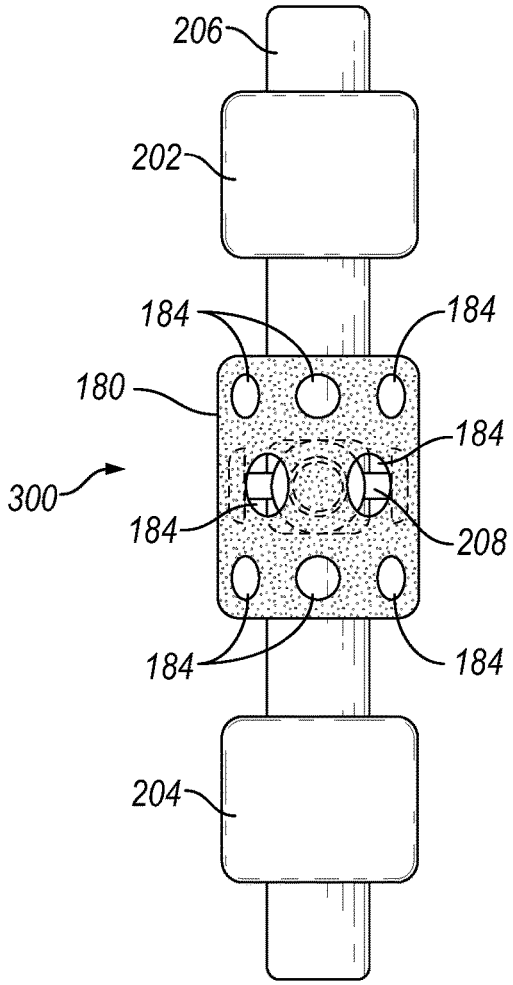
FIG. 3A illustrates a layered example of a probe assembly with a removable filter cover removed.
Figure 3B:
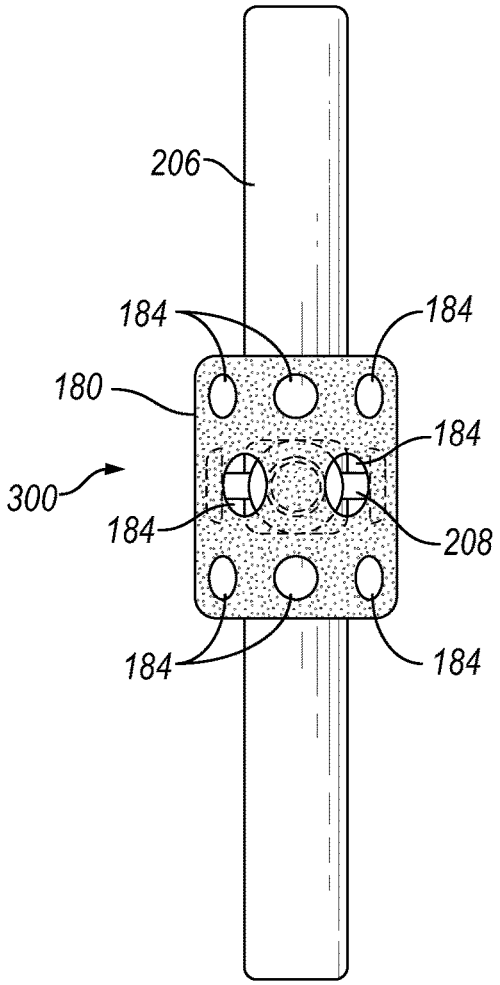
FIG. 3B illustrates probe assembly with removable filter cover removed without the application of packers.

FIG. 3A illustrates a layered example of a probe assembly 300 with removable filter cover 182 removed. Probe assembly 300 may be configured to extract and inject fluid in and out of tool body 206 from reservoir 117. Herein, fluid extracted from the reservoir 117 may be referred to as a fluid sample. In examples, one or more fluid samples may be extracted from reservoir 117 and stored within downhole fluid sampling tool 110. In further examples, downhole fluid sampling tool 110 may comprise one or more fluid sample chambers (not illustrated) configured to store one or more fluid samples. The one or more fluid sampling chambers are fluidically coupled to flow ports 122 and 124 via a channel running through downhole fluid sampling tool 110. Further, one or more pumps may be configured to induce a difference in pressure to force one or more fluid samples down the channel. Additionally, filter 180 may remove particulates from fluid samples, as fluid samples enter tool body 206. FIG. 3B illustrates probe assembly 300 without the application of packers 202 and 204.

Figure 4:
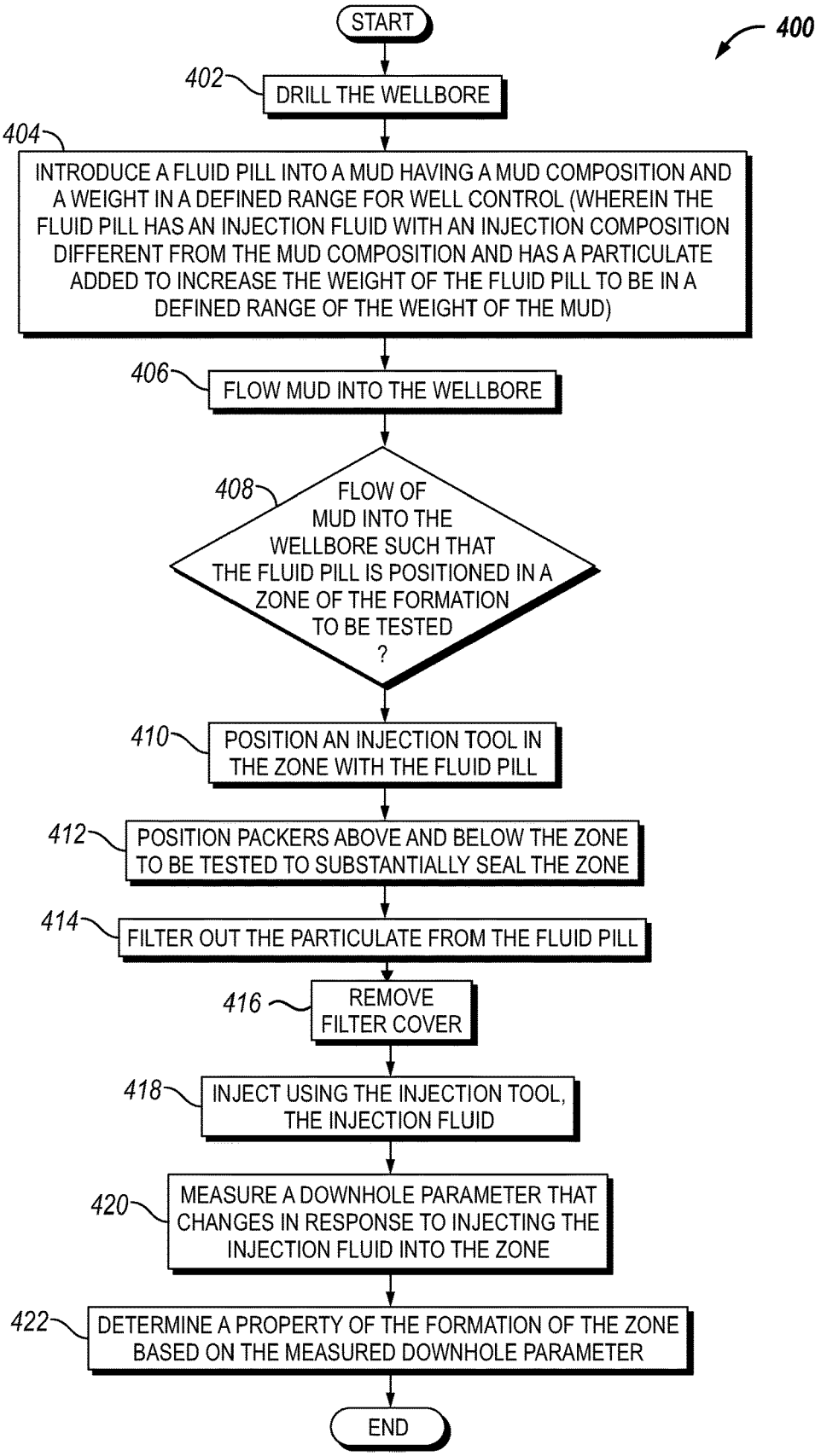
FIG. 4 illustrates a flowchart of example operations for reverse drill stem testing.

Example operations for performing reverse drill stem testing are now described. FIG. 4 illustrates a flowchart of example operations for reverse drill stem testing, according to some examples. At least a flow portion of the operations of a flowchart 400 of FIG. 4 may be performed by the example reservoir test system of FIG. 1 and the example packer and probe assemblies 200 and 300 depicted in FIGS. 2 and 3 (e.g., referring to FIGS. 2 and 3). Operations of the flowchart 400 start at block 402.

At block 402, a wellbore may be drilled. For example, with reference to FIG. 1, the wellbore 107 has been drilled into the reservoir 117. An example drilling system with a drill string (pipe) for drilling the wellbore may be depicted in FIG. 4 (which may be further described below).

At block 404, a fluid pill may be introduced into a mud having a mud composition and a weight in a defined range for well control, wherein the fluid pill has an engineered fluid with an injection composition different from the mud composition and has a particulate added to increase the weight of the fluid pill to be in a defined range of the weight of the mud. For example, with reference to FIG. 1, a fluid pill may be added into mud being pumped into the wellbore 107 by the pump 170.

At block 406, the mud flows into the wellbore. For example, with reference to FIG. 1, the mud (with the added fluid pill) may then be pumped into the wellbore 107 by the pump 170.

At block 408, a determination may be made of whether flow of the mud into the wellbore may be such that the fluid pill may be positioned in the zone of interest of the reservoir to be tested. For example, with reference to FIG. 1, the injection controller 146 may control the pump 170 such that the pump 170 pumps the mud into the wellbore 107 until the fluid pill would be at a depth of the zone of interest of the reservoir to be tested.

At block 410, an injection tool may be positioned in the zone of interest with the fluid pill. For example, with reference to FIG. 1, the downhole fluid sampling tool 110 may be conveyed into the wellbore 107 at the distal end of the test string 104 that may comprise drill pipes. Alternatively, the downhole fluid sampling tool 110 may be coupled to a wireline for conveyance into the wellbore 107.

At block 412, packers are positioned above and below the zone of interest to be tested to substantially seal the zones of interest. For example, with reference to FIG. 1, the packers 140 and 142 may be positioned above and below the zones of interest to be tested.

At block 414, the particulate may be filtered out from the fluid pill. For example, with reference to FIG. 1, the downhole fluid sampling tool 110 may comprise a filter that may be configured to be able to filter out the particulate that has been added to the fluid pill for the added weight. At block 416, removable filter cover 182 (e.g., referring to FIGS. 2A-2C) may be removed from around filter 180, as previously described.

At block 418, the engineered fluid may be injected into the zones of interest using the injection tool. For example, with reference to FIG. 1, the downhole fluid sampling tool 110 may inject the engineered fluid in the fluid pill (after filtering out the particulate) into the zones of interest of the reservoir to be tested. While the flowchart 400 may be described in reference to one fluid pill, as described above, In one or more examples workflow 400 may comprise multiple fluid pills. The multiple fluid pills may be for one or more zones of interest for the reservoir to be tested. The multiple fluid pills for one zone of interest may be adjacent to each other and/or separated by mud. In some examples with multiple fluid pills for one zone of interest, each fluid pill may be a separate engineered fluid with different properties. In such examples, the same zone of interest may be tested with different engineered fluids to provide a more accurate evaluation of the zone of interest. For example, each engineered fluid could have a different viscosity, a different flow rate, etc. Alternatively, or in addition for examples with multiple fluid pills for the same zone of interest, one or more fluid pills may comprise a fluid to clean the flow path into the zone of interest prior to the injection test. For example, a fluid pill may comprise a surfactant to clean the flow path for the engineered fluid. A subsequent fluid pill having an engineered fluid may then be positioned in the same zone of interest to be injected into the reservoir for reservoir testing and evaluation.

At block 420, a downhole parameter that changes in response to injecting the engineered fluid into zones of interest may be measured. For example, with reference to FIG. 1, the downhole fluid sampling tool 110 may be used to perform a fall off test by measuring a pressure of the zone of interest as it changes over time. The engineered fluid may be at or near the hydrostatic pressure while the reservoir may be at some lower pressure. After the engineered fluid flows into the reservoir and shut in, the pressure of the reservoir may be at or near the hydrostatic pressure. However, over time the pressure will return back to the reservoir pressure prior to the injection.

At block 422, a property of the reservoir of the zone of interest may be determined based on the measured downhole parameter. For example, with reference to FIG. 1, a computer downhole and/or at the surface may determine a property of the reservoir of the zone of interest based on the measure downhole parameter. To illustrate, the rate of the fall of the pressure may be indicative of the hydrocarbon bearing properties of the reservoir. Operations of the flowchart 400 are complete.

The flowcharts are provided to aid in understanding the illustrations and are not to be used to limit scope of the claims. The flowcharts depict example operations that may vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, may be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (comprising firmware, resident software, micro-code, etc.), or a combination of software and hardware aspects that may all generally be referred to herein as a "circuit," "module" or "system." The functionality presented as individual modules/units in the example illustrations may be organized differently in accordance with any one of platform (operating system and/or hardware), application ecosystem, interfaces, programmer preferences, programming language, administrator preferences, etc.

Systems and methods of the present disclosure are improvements over current technology in that current technology does not protect a downhole fluid sampling during conveyance through a wellbore. In particular methods and systems discussed above implement a cover filter for protecting a downhole fluid sampling tool 110 during a conveyance. Further, there may be multiple implementations of a cover filter for protecting a downhole fluid sampling tool 110.

The preceding description provides various examples of systems and methods of use which may contain different method steps and alternative combinations of components. It should be understood that, although individual examples may be discussed herein, the present disclosure covers all combinations of the disclosed examples, including, without limitation, the different component combinations, method step combinations, and properties of the system. The systems and methods may comprise any of the various features disclosed herein, comprising one or more of the following statements.

Statement 1. A downhole fluid sampling tool comprising: a tool body; a flow port disposed on the tool body; a sample chamber disposed within the tool body and fluidly coupled to the flow port; a pump disposed within the tool body, wherein the pump is configured to pump a fluid through the flow port into the sample chamber; a filter disposed on an inlet of the flow port, wherein the filter is configured to filter the fluid entering the flow port; and a removable filter cover configured to prevent fluid contact with the filter.

Statement 2. The downhole fluid sampling tool of statement 1, wherein the flow port comprises one or more probes.

Statement 3. The downhole fluid sampling tool of statement 2, wherein the one or more probes comprise at least one probe selected from the group consisting of a dual probe, a single probe, a focused probe, a packer probe, a multi-section probe, and combinations thereof.

Statement 4. The downhole fluid sampling tool of any of statements 1-2, further comprising a second flow port and a second filter disposed on the second flow port, wherein the second filter is configured to filter a fluid entering the second flow port, and wherein the second filter further comprises a second removable filter cover.

Statement 5. The downhole fluid sampling tool of any of statements 1-4, wherein the filter comprises at least one filter selected from the group consisting of a screen filter, a frit filter, a mesh filter, a slot filter, a media filter, a printed filter, and combinations thereof.

Statement 6. The downhole fluid sampling tool of any of statements 1-5, wherein the removable filter cover comprises a wax.

Statement 7. The downhole fluid sampling tool of statement 6, wherein the wax comprises a paraffin wax, and wherein the paraffin wax is brushed onto the filter or poured into a mold and connected to the filter.

Statement 8. The downhole fluid sampling tool of any of statements 1-7, wherein the removable filter cover comprises a hydrolysable material.

Statement 9. The downhole fluid sampling tool of any of statements 1-8, wherein the removable filter cover is connected to an actuator, wherein the actuator is configured to move the removable filter cover to allow fluid to contact the filter.

Statement 10. The downhole fluid sampling tool of statement 9, wherein the removable filter cover comprises thermoplastic and/or steel.

Statement 11. A method comprising: disposing a downhole fluid sampling tool into wellbore, wherein the downhole fluid sampling tool comprises: a tool body; a flow port disposed on the tool body; a sample chamber disposed within the tool body and fluidly coupled to the flow port; a pump disposed within the tool body, wherein the pump is configured to pump a fluid through the flow port into the sample chamber; a filter disposed on an inlet of the flow port, wherein the filter is configured to filter the fluid entering the flow port; and a removable filter cover configured to prevent fluid contact with the filter; removing the removable filter cover from the filter; and filtering at least a portion of the engineered fluid pill using the filter.

Statement 12. The method of statement 11, further comprising positioning a pill of engineered fluid into the wellbore, wherein the engineered fluid comprises a base fluid and particulates and positioning the downhole fluid sampling tool into the pill of engineered fluid.

Statement 13. The method of any of statements 11-12, wherein the removable filter cover comprises a wax and wherein removing the removable filter cover comprises allowing the wax to melt in the wellbore.

Statement 14. The method of any of statements 11-13, wherein the removable filter cover comprises a hydrolysable material and wherein removing the removable filter cover comprises allowing the hydrolysable material to hydrolyze with water present in the wellbore.

Statement 15. The method of any of statements 11-14, wherein the removable filter cover is connected to an actuator, and wherein removing the removable filter cover comprises actuating the actuator to move the removable filter cover.

Statement 16. The method of statement 15 wherein the one or more removable filter covers comprise thermoplastic and/or steel.

Statement 17. The method of any of statements 11-16, wherein the flow port comprises one or more probes.

Statement 18. The method of statement 17, wherein the one or more probes comprise at least one probe selected from the group consisting of a dual probe, a single probe, a focused probe, a packer probe, a multi-section probe, and combinations thereof.

Statement 19. The method of any of statements 11-18, wherein the downhole fluid sampling tool further comprises a second flow port and a second filter disposed on the second flow port, wherein the second filter is configured to filter a fluid entering the second flow port, and wherein the second filter further comprises a second removable filter cover.

Statement 20. The method of any of statements 11-19, wherein the filter comprises at least one filter selected from the group consisting of a screen filter, a frit filter, a mesh filter, a slot filter, a media filter, a printed filter, and combinations thereof.

It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces.

Therefore, the present examples are well adapted to attain the ends and advantages mentioned as well as those that are inherent therein. The particular examples disclosed above are illustrative only, as the present invention may be modified and practiced in different but equivalent manners apparent to those skilled in the art having the benefit of the teachings herein. Although individual examples are discussed, the invention covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It may be therefore evident that the particular illustrative examples disclosed above may be altered or modified and all such variations are considered within the scope and spirit of the present invention. If there may be any conflict in the usages of a word or term in this specification and one or more patent(s) or other documents that may be incorporated herein by reference, the definitions that are consistent with this specification should be adopted.

What is claimed is:

1. A downhole fluid sampling tool comprising:

a tool body;

a flow port disposed on the tool body;

a sample chamber disposed within the tool body and fluidly coupled to the flow port;

a pump disposed within the tool body, wherein the pump is configured to pump a fluid through the flow port into the sample chamber;

a filter disposed on an inlet of the flow port, wherein the filter is configured to filter the fluid entering the flow port; and a removable filter cover selectively movable between a first position where the removable filter cover prevents fluid contact with the filter and a second position where the removable filter cover allows fluid contact with the filter.

2. The downhole fluid sampling tool of claim 1, wherein the flow port comprises one or more probes.

3. The downhole fluid sampling tool of claim 2, wherein the one or more probes comprise at least one probe selected from the group consisting of a dual probe, a single probe, a focused probe, a packer probe, a multi-section probe, and combinations thereof.

4. The downhole fluid sampling tool of claim 1, further comprising a second flow port and a second filter disposed on the second flow port, wherein the second filter is configured to filter a fluid entering the second flow port, and wherein the second filter further comprises a second removable filter cover.

5. The downhole fluid sampling tool of claim 1, wherein the filter comprises at least one filter selected from the group consisting of a screen filter, a frit filter, a mesh filter, a slot filter, a media filter, a printed filter, and combinations thereof.

6. The downhole fluid sampling tool of claim 1, wherein the removable filter cover comprises a thermoplastic material.

7. The downhole fluid sampling tool of claim 6, wherein the thermoplastic becomes plastic when heated and hardened when cooled.

8. The downhole fluid sampling tool of claim 1, wherein the removable filter cover comprises steel.

9. The downhole fluid sampling tool of claim 8, wherein the steel is an alloy of at least iron and carbon.

10. A method comprising:

disposing a downhole fluid sampling tool into wellbore, wherein the downhole fluid sampling tool comprises:

a tool body;

a flow port disposed on the tool body;

a sample chamber disposed within the tool body and fluidly coupled to the flow port;

a pump disposed within the tool body, wherein the pump is configured to pump a fluid through the flow port into the sample chamber;

a filter disposed on an inlet of the flow port, wherein the filter is configured to filter the fluid entering the flow port; and a removable filter cover selectively movable between a first position where the removable filter cover prevents contact with the filter and a second position where the removable filter cover allows fluid contact with the filter.

11. The method of claim 10, further comprising positioning the downhole fluid sampling tool at a zone of interest prior to moving the removable filter cover to the second position.

12. The method of claim 10, wherein the removable filter cover comprises a thermoplastic material.

13. The method of claim 12, wherein the thermoplastic becomes plastic when heated and hardened when cooled.

14. The method of claim 10, wherein the removable filter cover comprises a steel.

15. The method of claim 14, wherein the steel is an alloy of at least iron and carbon.

16. The method of claim 10, wherein the flow port comprises one or more probes.

17. The method of claim 16, wherein the one or more probes comprise at least one probe selected from the group consisting of a dual probe, a single probe, a focused probe, a packer probe, a multi-section probe, and combinations thereof.

18. The method of claim 10, wherein the downhole fluid sampling tool further comprises a second flow port and a second filter disposed on the second flow port, wherein the second filter is configured to filter a fluid entering the second flow port, and wherein the second filter further comprises a second removable filter cover.

19. The method of claim 10, wherein the filter comprises at least one filter selected from the group consisting of a screen filter, a frit filter, a mesh filter, a slot filter, a media filter, a printed filter, and combinations thereof.

* * * * *